US006974360B2

(12) United States Patent
Fukai et al.

(10) Patent No.: US 6,974,360 B2
(45) Date of Patent: Dec. 13, 2005

(54) METHOD OF PRODUCING AN ARC TUBE FOR A DISCHARGE LAMP DEVICE

(75) Inventors: Kunio Fukai, Shizuoka (JP); Hiroshi Goto, Shizuoka (JP); Yoshihiro Mochizuki, Shizuoka (JP); Yukihiro Yoshida, Shizuoka (JP); Shinichi Irisawa, Shizuoka (JP); Takeshi Fukuyo, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 214 days.

(21) Appl. No.: 10/455,778

(22) Filed: Jun. 6, 2003

(65) Prior Publication Data

US 2004/0009733 A1 Jan. 15, 2004

(30) Foreign Application Priority Data

Jun. 6, 2002 (JP) ..... P.2002-165340

(51) Int. Cl.[7] ..... H01J 9/00; H01J 17/04; H05B 33/10

(52) U.S. Cl. ..... 445/26; 313/631

(58) Field of Search ..... 445/29, 26, 22, 445/69; 29/837, 838

(56) References Cited

U.S. PATENT DOCUMENTS 5,108,333 A * 4/1992 Heider et al. ..... 428/26
5,268,227 A * 12/1993 Nishikawa et al. ..... 428/336
6,071,164 A * 6/2000 Vollmer ..... 445/26
6,132,279 A * 10/2000 Horiuchi et al. ..... 445/26
6,452,334 B1 * 9/2002 Ohshima et al. ..... 313/623

FOREIGN PATENT DOCUMENTS

JP 8-227661 9/1996

* cited by examiner

*Primary Examiner*—Mariceli Santiago
*Assistant Examiner*—Elizabeth Rielley
(74) *Attorney, Agent, or Firm*—Sughrue Mion, PLLC

(57) ABSTRACT

A method of producing an arc tube including inserting an electrode assembly in which a bent portion is formed in a lead wire into a glass tube to self-hold the electrode assembly to a predetermined position of the glass tube. After the electrode has been inserted to the predetermined position, pinch-sealing is conducted on a portion of the glass tube where the assembly is inserted. In the method, the electrode assembly is inserted into a metal guide pipe which is coaxially disposed with respect to the glass tube, to be once held into the pipe. Thereafter, the assembly may be pushed by a thin rod-like pushing member to be inserted to the predetermined position in the glass tube. One or more vertical grooves which are to be axially engaged with the bent portion of the assembly to circumferentially lock the bent portion may be formed in the inner side of the guide pipe. Using the one or more grooves, the assembly may be guided to the glass tube W without being in sliding contact with the guide pipe. Therefore, in a preferable embodiment, this prevents metal powder, which may be produced by rubbing and shaving the inner side of the guide pipe with the bent portion of the lead wire, from entering the chamber portion as a foreign matter. A holding chuck is not required to insert the assembly into the glass tube, but is used to facilitate insertion of the assembly into the guide pipe. The chuck for holding the assembly is not restricted in shape. The assembly in the guide pipe is guided to the glass tube and may be restricted by the vertical grooves to be circumferentially positioned.

10 Claims, 9 Drawing Sheets

| | METHOD OF EMBODIMENT | COMPARATIVE EXAMPLE |
|---|---|---|
| NUMBER OF TESTS | 167 | 47 |
| NUMBER OF FLICKER OCCURRENCES | 2 | 9 |
| FLICKER OCCURRENCE RATE (%) | 1.2 | 19.1 |
| FOREIGN MATERIAL (Fe, Ni, Cr) | ≦500ppm (MEAN) | 2% (MEAN) |

PRIOR ART

PRIOR ART

METHOD OF PRODUCING AN ARC TUBE FOR A DISCHARGE LAMP DEVICE

BACKGROUND OF THE INVENTION

1. Field of the Invention

The present invention relates to a method for producing an arc tube for a discharge lamp device. More particularly, the invention relates to a method for producing an arc tube wherein a novel guide pipe and pushing member may be used to facilitate insertion of the electrode assembly into the glass tube of the arc tube.

2. Description of the Related Art

As shown in FIG. 9, an arc tube for a discharge lamp device has a structure in which a sealed chamber portion 5*a*, in which electrode rods 6 are opposed to each other and a light emitting substance and the like are hermetically enclosed, is formed between a pair of front and rear pinch seal portions 5*b*. An electrode assembly A or A' is sealingly attached to each of the pinch seal portions 5*b* to ensure the gas-tightness of the sealed chamber portion 5*a*. In the electrode assembly, the electrode rod 6 which is protruded into the sealed chamber portion 5*a*, a lead wire 8 which is led from the pinch seal portion 5*b*, and a molybdenum foil 7 through which the rod 6 and the wire 8 are connected to each other are connected and integrated to one another.

The arc tube 5 is produced by the following method. As shown in FIG. 10A, first, the electrode assembly A, in which the electrode rod 6, the molybdenum foil 7, and the lead wire 8 are connected and integrated to one another, is inserted into a cylindrical glass tube W from the side of one open end. In the glass tube, a chamber portion w2 is formed in a middle of a linear elongated portion w1. A position q1 in the vicinity of the chamber portion w2 is first-pinch-sealed. As shown in FIG. 10B, thereafter, a light emitting substance P and the like are introduced into the chamber portion w2 from the side of the other open end, and, as shown in FIG. 10C, the other electrode assembly A' (see FIG. 11) in which a bent portion 8*a* is formed in the lead wire 8 is then inserted into the glass tube to be self-held thereinto. Specifically, in the electrode assembly A' inserted into the glass tube W, the bent portion 8*a*, having a width which is larger than the inner diameter of the glass tube W, is formed in the lead wire 8. The bent portion 8*a* pressingly contacts with the inner peripheral face of the glass tube W. The electrode assembly is self-held by the force due to the press contact to the position where the electrode assembly is inserted. Thereafter, the other open end of the glass tube W is provisionally sealed using burners. The portion of the glass tube W where the electrode assembly A' is inserted is second-pinch-sealed, and the glass tube W is cut at a predetermined position on the side of the provisional sealing to expose the lead wire 8 from the glass tube W.

Preferably, the articles in (the chamber portion of) the arc tube are enclosed without being contaminated as a result of contact with the atmosphere. Therefore, the steps from the step of charging of the light emitting substance P and the like to that of provisional sealing are conducted in the form where, as shown in FIG. 12, an upper open end portion of the glass tube W is fixedly held to a cylindrical connection head 2 disposed in a glove box 1 which is filled with argon gas, and the glass tube W communicates with the glove box 1. In the step of inserting the electrode assembly A' into the glass tube W, the electrode assembly A' is held by a holding chuck 4 of a holding member 3, and the electrode assembly is then inserted into the glass tube W through a hole 2*a* of the connection head 2.

In the step of inserting the electrode assembly A', it is required to correctly insert the electrode assembly A' on the second-pinch-seal side into the glass tube W so that the electrode assembly A' is positioned symmetrically with the electrode assembly A on the first-pinch-seal side. However, the connection head 2 has an axially elongated shape in which vent holes and portions for fixing with the glove box are formed, the hole 2*a* of the connection head 2 is narrow, and the chamber portion w2 is located at a considerably lower position. Therefore, the holding chuck 4 is so thin that the force of holding the electrode assembly A' is insufficiently exerted. As a result, there arises a problem in that it is difficult to correctly insert the electrode assembly A' to an adequate position, or particularly so that the position of the molybdenum foil 7 coincides circumferentially with that of the molybdenum foil on the first-pinch-seal side.

In order to solve the aforementioned problem, the inventor of the present invention conceived the following configuration. As shown in FIGS. 13A and 13B, a funnel-like guide pipe 9 having a hole which is equal in inner diameter to the hole of the glass tube W is attached to the hole 2*a* of the connection head 2 from the upper side. The electrode assembly A' is inserted into the guide pipe 9 from the upper side, thereby causing the electrode assembly A' to be once self-held into the guide pipe 9 by the pressure contact force which is exerted by the bent portion 8*a* of the lead wire 8 on the pipe wall. Thereafter, the electrode assembly A' is pushed by a thin rod-like pushing member 9*a* to be advanced to a predetermined position in the glass tube W. As a result, the dimensional restriction of the holding chuck 4 (the restriction that the holding chuck must be thin and long) is eliminated, and an adequate force required for holding the electrode assembly A' can be ensured. Preferably, the guide pipe 9 is made of a material which hardly introduces pollutants into the glove box 1. One such material is stainless steel, which has excellent rustproofness and is washable.

In this configuration, unlike the related art, it is not necessary for the holding chuck 4 to have a thin shape which enables the holding chuck to be deeply inserted into the glass tube W, rather, the holding chuck 4 is required only to have a function of allowing the electrode assembly A' into the guide pipe 9. Therefore, it was confirmed that a sufficient force of holding the electrode assembly A' can be ensured even when the holding chuck is reduced in length and increased in thickness.

In an arc tube produced by the above-described method in which the electrode assembly A' is inserted into the glass tube W via the guide pipe 9, however, there arose new problems of a flickering phenomenon, an abnormal emission color, and an insufficient luminous flux. The present inventor searched for a cause of these problems, and found the following phenomenon. When the electrode assembly A' is pushed into the glass tube W via the guide pipe 9, the inner peripheral face of the stainless steel guide pipe 9 is rubbed with the bent portion 8*a* of the molybdenum lead wire 8 to be shaved off, and shaved stainless steel chips in the form of powder drop into the chamber portion w2. The stainless steel powder is enclosed in the chamber portion w2 as a result of the second pinch seal. Therefore, stainless steel powder which should not exist in the chamber portion w2 exists as a foreign matter in the portion, causing a flickering phenomenon, an abnormal emission color, an insufficient luminous flux, etc.

In order to prevent the phenomenon from occurring, the inventor conceived a configuration in which a longitudinal groove is formed in the inner side of the guide pipe 9, and the groove is to be axially engaged with the bent portion 8*a* of the lead wire of the electrode assembly A' to rotationally lock the bent portion 8*a*, whereby (the bent portion 8*a* of) the electrode assembly A' is prevented from being in sliding contact with the guide pipe 9 when the electrode assembly A' is pushed into the glass tube W via the guide pipe 9. The inventor repeated experiments, and finally found that the configuration is effective in preventing the problems from occurring, thereby accomplishing the present invention.

The invention has been conducted in view of the problems of the related art and additional findings by the inventor. It is an object of the invention to provide a method of producing an arc tube for a discharge lamp device in which, when an electrode assembly on the second-pinch-seal side is to be inserted into a glass tube, the electrode assembly can be inserted correctly and smoothly to a predetermined position in the glass tube without being in sliding contact with a guide pipe.

SUMMARY OF THE INVENTION

In order to attain the object, the method of producing an arc tube for a discharge lamp device of the invention comprises: inserting an electrode assembly into a glass tube to self-hold the electrode assembly to a predetermined position of the glass tube, the electrode assembly being formed by connecting and integrating an electrode rod and a molybdenum lead wire to each other via a molybdenum foil, a bent portion being formed in the lead wire, the bent portion having a width which is larger than an inner diameter of the glass tube; and a pinch seal step of pinch-sealing a portion of the glass tube where the electrode assembly is inserted, wherein the electrode assembly is inserted via a guide pipe which is coaxially disposed in close proximity to the glass tube, one or more grooves (for example, a pair of grooves) being disposed in an inner side of the guide pipe, the grooves being to be engaged with the bent portion of the lead wire.

During electrode insertion, the guide pipe may be coaxially disposed in close proximity to the glass tube, and the electrode assembly is inserted into the guide pipe to be once held into the pipe, and then inserted to a predetermined position in the glass tube. Of course, the guide pipe may also contact the glass tube depending on the glove box configuration. (Function) After the electrode assembly is inserted into the guide pipe which is disposed in close proximity to the glass tube, the electrode assembly can be pushed by a thin rod-like pushing member to be advanced to the predetermined position in the glass tube. Therefore, a holding chuck of a holding member for holding the electrode assembly and inserting the assembly into the glass tube is required to have only a function of inserting the electrode assembly into the guide pipe which is disposed in close proximity to an open end of the glass tube. Consequently, the shape restriction that the holding chuck must be thin and long is eliminated. When the holding chuck is configured to be thick and short, the holding chuck is ensured to exert a holding force by which the electrode assembly can be adequately grasped, so that the electrode assembly can be correctly inserted by using the holding chuck at a predetermined circumferential position where the bent portion of the lead wire is engaged with the grooves of the inner side of the guide pipe.

The one or more grooves which can be engaged with the bent portion of the lead wire of the electrode assembly are formed in the inner side of the guide pipe. The electrode assembly which is inserted into the guide pipe from the upper side falls in the guide pipe by gravitation, and once stops at a position where the bent portion of the lead wire butts against an upper open end of the glass tube. Since the bent portion of the lead wire is engaged with the grooves of the inner side of the guide pipe, the electrode assembly is circumferentially locked to be held to a form where the electrode assembly is circumferentially positioned. The electrode assembly which is pushed by the pushing member that is inserted into the guide pipe from the upper side is inserted from the guide pipe to the predetermined position in the glass tube, and holds the circumferential position (the circumferential position which is restricted by the guide pipe) which is attained before the electrode assembly is inserted into the glass tube. Therefore, it is not required to adjust the circumferential position of the electrode assembly in advance of the pinch seal step.

The grooves which can be engaged with the bent portion of the lead wire of the electrode assembly are formed in the inner side of the guide pipe. When the electrode assembly is to be inserted into the glass tube via the guide pipe, the electrode assembly can be guided into the glass tube without causing the bent portion of the lead wire of the electrode assembly to be in sliding contact with the guide pipe. Therefore, in this preferable embodiment, a phenomenon does not occur in which metal powder, produced by rubbing and shaving the inner side of the guide pipe with the bent portion of the lead wire, is enclosed in a chamber portion as a foreign matter.

(2) In the method of producing an arc tube for a discharge lamp device of (1) above, the electrode assembly which is inserted into the guide pipe is configured to be pushed into the glass tube by a pushing member which is inserted into the guide pipe, and a slit is formed in a tip end portion of the pushing member, the slit being to be axially engaged with the bent portion of the lead wire which portion is formed into an M-like shape, to circumferentially lock the M-shaped bent portion.

(Function) In the M-shaped bent portion of the lead wire, three bent places which are laterally protruded in an alternate manner pressingly contact with the inner peripheral face of the glass tube at respect opposed positions, so that the whole electrode assembly is stably self-held.

Since the M-shaped bent portion of the lead wire is engaged with the pair of grooves formed in the inner side of the guide pipe, the electrode assembly can be smoothly inserted into the guide pipe and circumferentially positioned with respect to the glass tube. Specifically, the slit of the tip end portion of the pushing member is axially engaged with the M-shaped bent portion of the lead wire to circumferentially lock the bent portion, and the circumferential position of the electrode assembly inserted into the glass tube can be correctly held to that which is attained before the electrode assembly is inserted into the glass tube (the circumferential position restricted by the pair of grooves).

(3) In the method of producing an arc tube for a discharge lamp device of (1) or (2), the guide pipe is placed in close proximity to an upper open end of the glass tube which vertically elongates, a stopper which is insertable into and retractable from the guide pipe is disposed on the guide pipe, the stopper being to be engaged with and disengaged from the bent portion of the lead wire of the electrode assembly which is inserted into the guide pipe, and the electrode assembly which is inserted into the guide pipe in the electrode assembly insertion step is engaged with the stopper to be held into the pipe.

(Function) The electrode assembly which is inserted into the guide pipe from the upper side is inserted into the pipe without being in sliding contact with the pipe wall, but once held into the guide pipe while the bent portion of the lead wire is engaged in the form where the bent portion of the lead wire is supported from the lower side by the stopper protruded into the pipe. When a form where the stopper is retracted from the guide pipe (a form where the stopper is not protruded into the pipe) is attained, the electrode assembly in which the support (engagement) of the bent portion of the lead wire from the lower side by the stopper is cancelled falls in the guide pipe by gravitation, and stops at a position where the bent portion butts against the upper end of the glass tube. At this time, the electrode assembly has a form where the insertion front side (the electrode rod and the molybdenum lead wire) of the electrode assembly enters the glass tube. The electrode assembly is then pushed by the pushing member which is lowered in the guide pipe, to be pressed into the glass tube while maintaining the form where the electrode assembly is circumferentially locked.

The electrode assembly insertion may be conducted in a limited enclosed space in an inert gas atmosphere, such as a glove box. Therefore, it can be difficult to vertically arrange all the members including the electrode assembly, the guide pipe, and the pushing member because such an arrangement requires an increased height of a glove box. Consequently, the insertion process is preferably configured so that the electrode assembly is inserted into the guide pipe at a position which is horizontally separated from the placement position of the glass tube, the guide pipe into which the electrode assembly is inserted and held is moved (for example, slid) to a position directly above the glass tube, and the guide pipe is then lowered to the vicinity of the opening of the glass tube. In the movement of the guide pipe, when the position of the stopper is set so that the downward protrusion of the inserted electrode assembly is made as small as possible, the guide pipe can be moved without interfering with other members, and the height of the glove box can be reduced.

When the method is configured so that the engagement of the electrode assembly by the stopper is cancelled in liaison with the movement in which the guide pipe into which the electrode assembly is inserted and held is lowered and made closer to the opening of the glass tube, the production apparatus can be configured in a simplified manner. For example, the apparatus may be configured in the following manner. Electrode assemblies are sequentially inserted into respective guide pipes. After the insertion of an electrode assembly is completed for all the guide pipes, all the guide pipes into which the electrode assemblies are respectively inserted and held are integrally moved in parallel to positions directly above the respective glass tubes, and the engagement of the electrode assembly by the stopper in all the guide pipes is canceled in liaison with the operation in which all the guide pipes are then lowered to be placed near the glass tubes. A plurality of pushing members are simultaneously lowered to concurrently insert the electrode assemblies into the glass tubes. As a result, the facility for the electrode assembly insertion step can be simplified.

DETAILED DESCRIPTION OF THE INVENTION

Figure 1A:
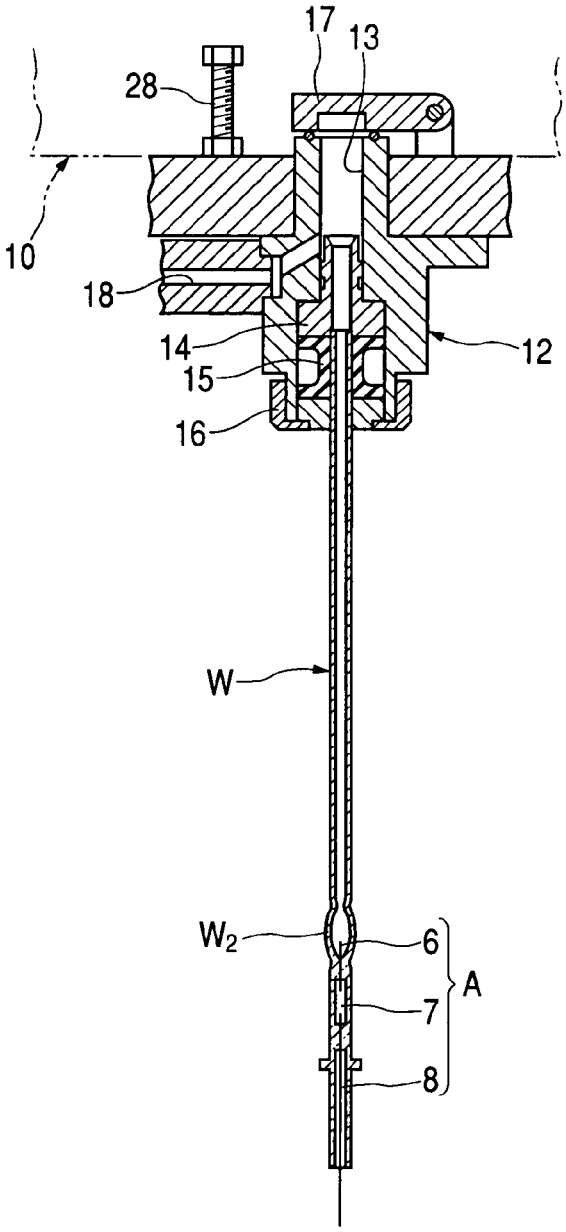
FIG. 1A is a diagram illustrating steps of evacuating and washing an arc tube for a discharge lamp device which has been first pinch sealed.

Hereinafter, a mode for carrying out the invention will be described by way of embodiments.

FIGS. 1 to 8 show an embodiment of the method of producing an arc tube for a discharge lamp device of the invention.

In the figures, 10 denotes a glove box which is used in steps from a step of charging a light emitting substance and the like into the glass tube W to that of provisional sealing, and which is filled with argon gas. A cylindrical connection head 12, in which a supply hole 13 is disposed, and which is made of stainless steel is fixed to a lower end portion of the glove box 10. A fastening piece 16 which is fixedly held in the form where a connection guide 14 made of stainless steel and a rubber bushing 15 are housed is disposed on the connection head 12. The interior of the glass tube W can be caused to communicate with that of the glove box 10 via the supply hole 13 of the connection head 12 by an air chuck in which an upper end portion of the glass tube W is inserted into a lower end opening of the connection head 12 and the rubber bushing 15 firmly fastens the glass tube W. The connection guide 14 functions to guide a supply nozzle for supplying pellets or mercury which is a light emitting substance described later to a chamber portion w2. An upper open end portion of the connection guide 14 is formed into a tapered shape so as to easily guide a tip end portion of such a supply nozzle. The upper end portion of the glass tube W is inserted into a lower end opening of the connection guide 14 in the connection head 12, and the axial center of the glass tube W correctly coincides with the axial centers of the connection head 12 and the connection guide 14. An openable and closable lid 17, which opens and closes the supply hole 13 with respect to the interior of the glove box 10, is disposed on the upper end of the connection head 12, and a vent hole 18 which communicates with the supply hole 13 is formed in the side of the connection head 12.

The reference character W denotes the glass tube which is to be formed into an arc tube, and which is connected to the connection head 12. An electrode assembly A in which an electrode rod 6, a molybdenum foil 7, and a molybdenum lead wire 8 are connected and integrated to one another is sealed by first pinch seal to an opening in the vicinity of the chamber portion w2 in a lower side of the glass tube W.

The reference character A' denotes an electrode assembly (see FIG. 4) on the second-pinch-seal side. The electrode assembly is identical with the electrode assembly A on the first-pinch-seal side in the configuration where an electrode rod 6, a molybdenum foil 7, and a molybdenum lead wire 8 are connected and integrated to one another, but different in that where an M-shaped bent portion 8*a* having a width which is larger than the inner diameter (2.0 mmϕ) of the glass tube W is formed so as to elongate perpendicular to the molybdenum foil 7. The M-shaped bent portion 8*a* in the lead wire 8 is formed so that the width D (see FIG. 5) is 2.2 mm which is larger than the inner diameter (2.0 mmϕ) of the glass tube W. When the electrode assembly A' is inserted into the glass tube W, three bent places 8*a*1, 8*a*2, and 8*a*3 of the bent portion 8*a* pressingly contact with the inner peripheral face of the glass tube W to support the weight of the electrode assembly A', and hence the electrode assembly A' is self-held to the position where the assembly is located as a result of the insertion (see FIG. 4D).

The reference numeral 20 denotes the guide pipe which is to be inserted into the supply hole 13 of the connection head 12 to be disposed in close proximity to the open end of the glass tube W and coaxially with the glass tube W, and into which the electrode assembly A' is to be inserted and held. The guide pipe 20 is configured so that, after the electrode assembly A' is inserted into the guide pipe 20 at a predetermined position which is horizontally separated from a position above the supply hole 13 of the connection head 12, the guide pipe 20 is slid to a position directly above the supply hole 13, and then lowered to be inserted and placed into the supply hole 13 as shown FIGS. 2A and 2B.

Figure 5A:
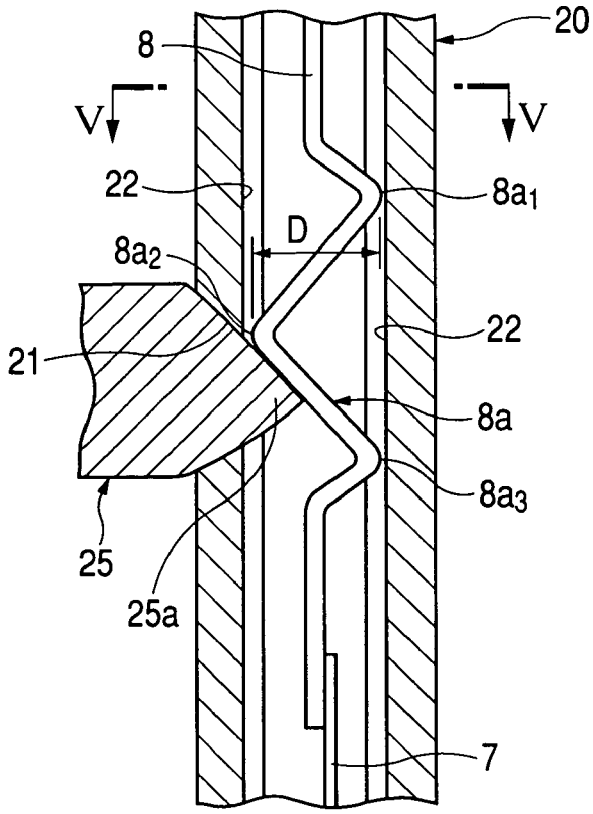
FIG. 5A is a longitudinal section view showing a manner of engaging the electrode assembly inserted into the guide pipe, with a stopper.
Figure 5B:
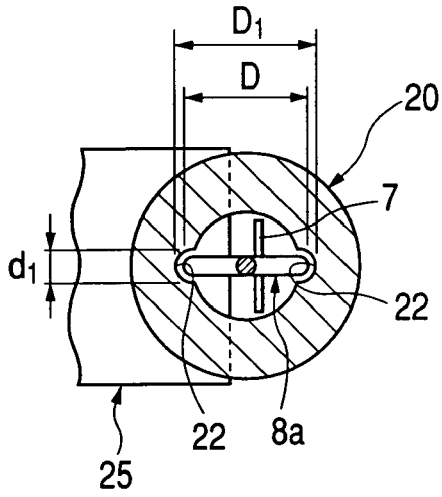
FIG. 5B is a horizontal section view (a section view taken along the line V—V in FIG. 5A) showing a manner of engagement of a bent portion of a lead wire of the electrode assembly with vertical grooves of the guide pipe.

As shown in FIGS. 5A and 5B, a pair of vertical grooves 22 which are to be engaged with the M-shaped bent portion 8*a* of the lead wire 8 are opposingly formed in the inner side of the guide pipe 20, so that the bent portion 8*a* is axially loosely fitted into and circumferentially positioned with respect to the guide pipe 20. Namely, the guide pipe 20 is inserted and held into the connection head 12 so that the vertical grooves 22 are positioned so as to correspond to the molybdenum foil 7 on the first-pinch-seal side. The distance D1 between the vertical grooves 22 is 2.4 mm which is larger than the width D (=2.2 mm) of the bent portion 8*a* of the lead wire 8, and the width d1 of each of the vertical grooves 22 is 0.6 mm which is larger than the thickness of 0.4 mm of the lead wire 8, so that the bent portion 8*a* of the lead wire 8 is axially loosely fitted into and circumferentially positioned with respect to the guide pipe 20.

In the guide pipe 20, a part of the pipe wall is cut away as indicated by 21. A stopper lever 25 which swings about a pivot shaft 26 and enters the cut-away portion 21 to be engaged with and disengaged from the bent portion 8*a* of the electrode assembly A' that is inserted into the guide pipe 20 is disposed on the side of the guide pipe 20. In an electrode assembly insertion step which will be described later, therefore, the electrode assembly A' which is inserted into the guide pipe 20 is engaged in the form where the bent portion 8*a* of the lead wire 8 is supported from the lower side by a stopper portion 25*a* protruded into the pipe, and once held into the guide pipe 20. When the stopper lever 25 swings to be disengaged from the cut-away portion 21, the stopper portion 25*a* has a form where it is retracted from the pipe (a form where it is not protruded into the pipe), and the electrode assembly A' in which the supporting (engagement) by the bent portion 8*a* of the lead wire 8 from the lower wide is canceled falls in the guide pipe 20 by gravitation without interfering with the wall.

Figures 7, 8:
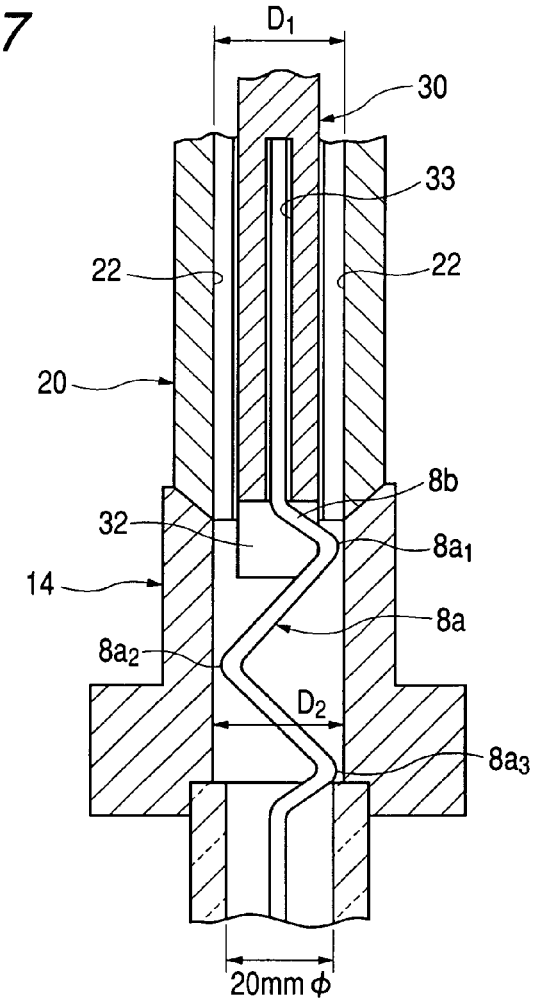
FIG. 7 is a longitudinal section view showing a state where the electrode assembly is pushed into the glass tube by the pushing member.
FIG. 8 is a view showing a flicker occurrence rate in arc tubes which were produced by the method of the embodiment.
Figure 9:
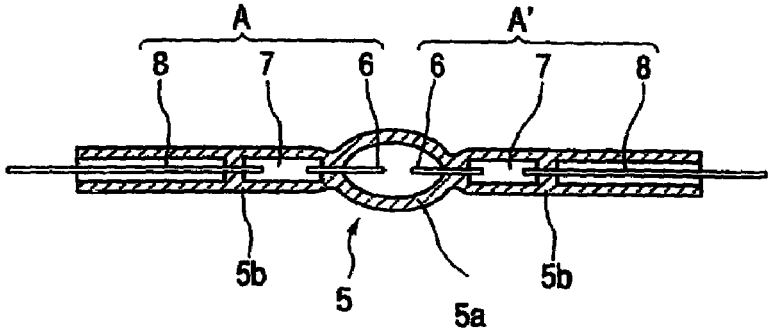
PRIOR ART FIG. 9
FIG. 9 is a longitudinal section view of a conventional arc tube for a discharge lamp device.
Figure 10A:
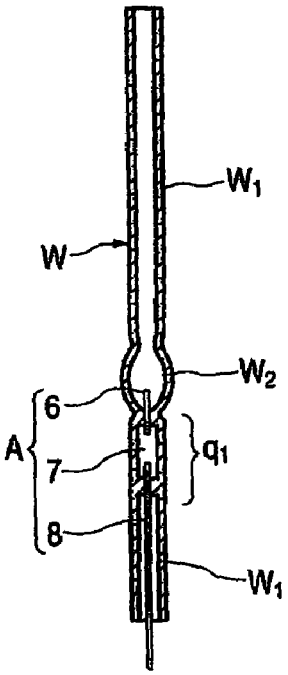
FIG. 10 is a diagram illustrating conventional steps of producing an arc tube.
Figure 10B:
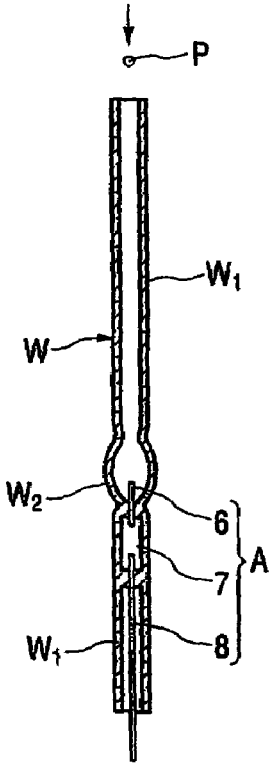
PRIOR ART FIG. 10(b)
Figure 10C:
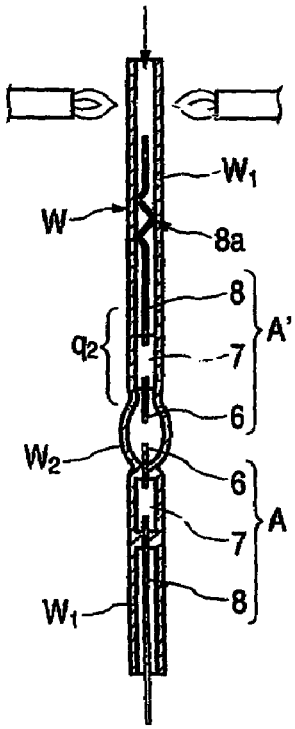
PRIOR ART FIG. 10(c)
Figure 11:
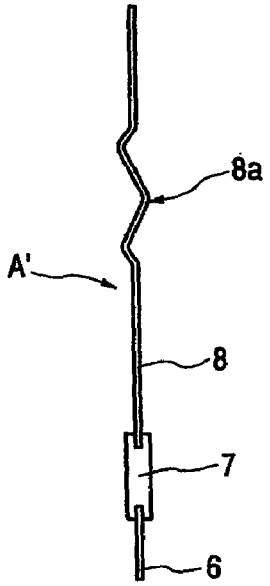
FIG. 11 is an enlarged side view of an electrode assembly.
Figure 12:
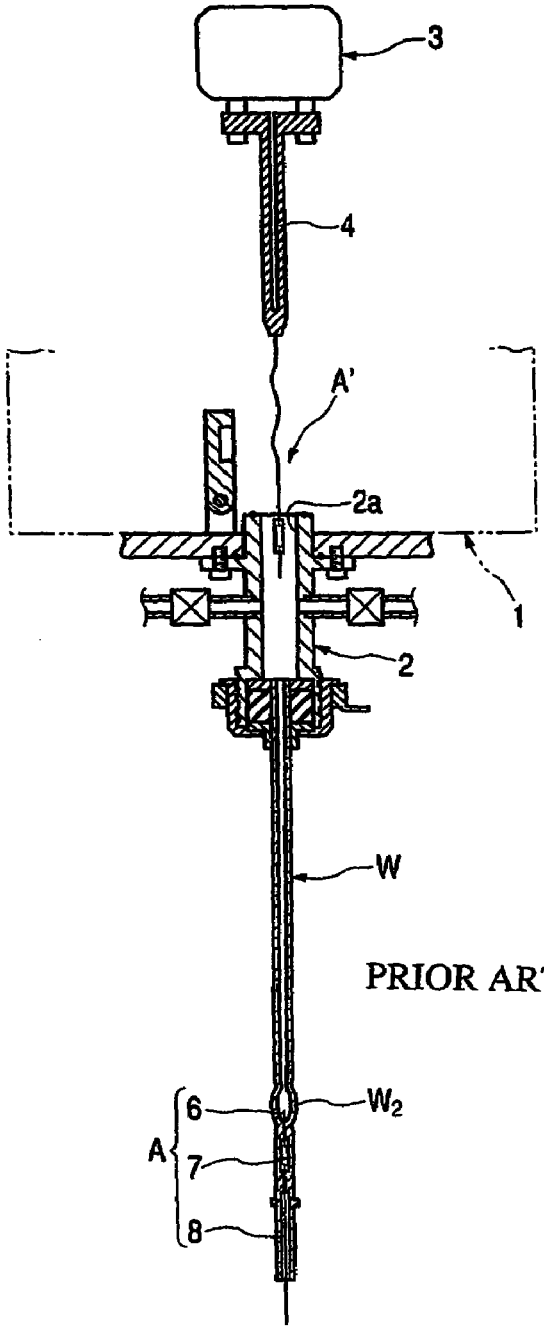
PRIOR ART FIG. 12
FIG. 12 is a diagram illustrating an electrode assembly insertion step.
Figure 13A:
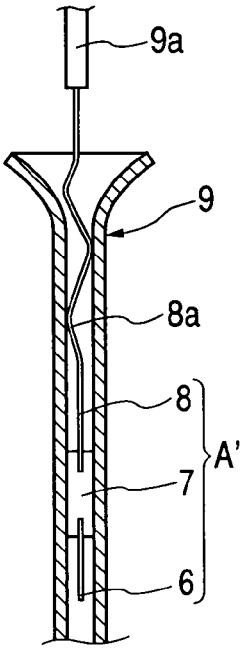
FIG. 13A is an enlarged section of a guide pipe which was conceived by the inventor.
Figure 13B:
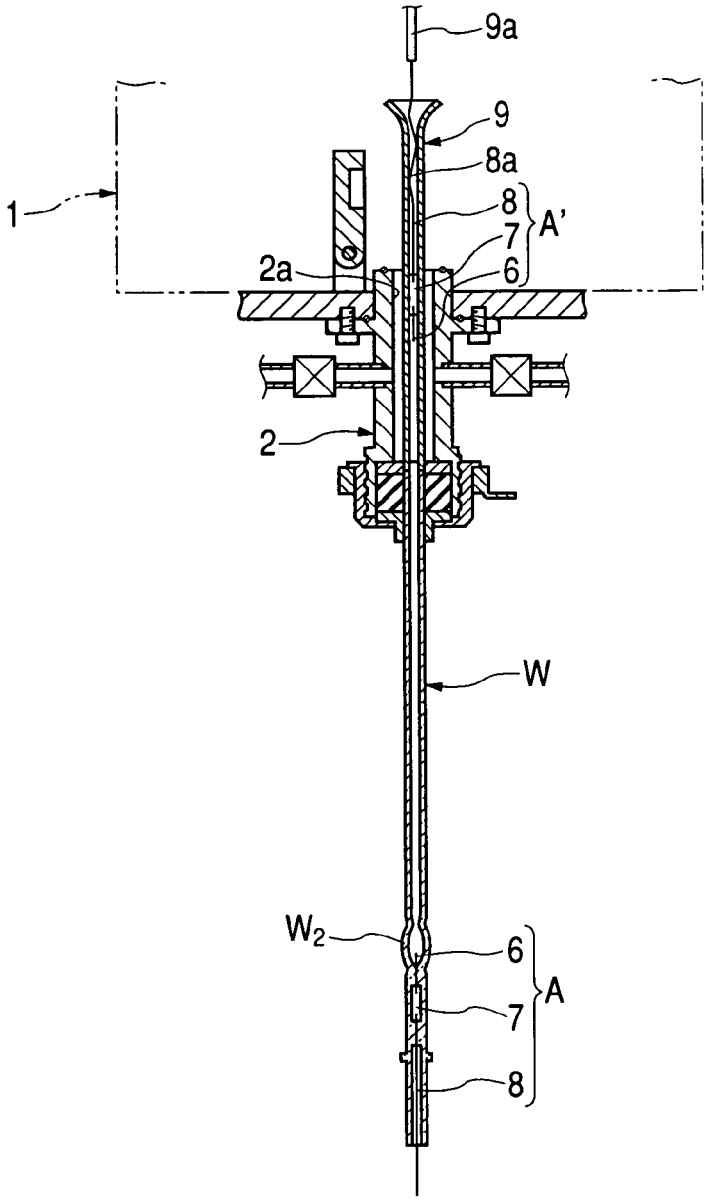
FIG. 13B is a diagram illustrating an electrode assembly insertion step on the second-pinch-seal side in which the guide pipe is used.

The connection guide 14, which is made of stainless steel, is housed and fixed to the lower portion of the connection head 12. As shown in FIG. 7, the inner diameter D2 of the connection guide 14 is 2.4 mm, which is equal to the distance D1 between the vertical grooves 22 of the guide pipe 20, and which is larger than the inner diameter (2.0 mm) of the glass tube W. Therefore, the electrode assembly A' in which the engagement by the stopper lever 25 is canceled falls smoothly in the connection guide 14 without interfering with the wall. Then, the tip end portion (the electrode rod and the molybdenum foil) of the assembly enters the glass tube W, and is held at a position where the bent portion 8*a* of the lead wire butts against the upper open end of the glass tube W.

A pin 28 for canceling the engagement by the stopper lever is protruded in the vicinity of the supply hole 13 of the connection head 12 in the glove box 10. As shown in FIG. 2B, when the guide pipe 20 is lowered and then inserted into the supply hole 13, the stopper lever 25 butts against the pin 28 to swing in a direction along which the stopper portion 25*a* separates from the cut-away portion 21, whereby the engagement of the electrode assembly A' is automatically canceled. When the stopper lever 25 swings to cancel the engagement of the electrode assembly A' by the stopper portion 25*a*, therefore, the electrode assembly A' falls in the guide pipe 20 and the connection guide 14, and has a form where the bent portion 8*a* butts against the upper open end of the glass tube W (see FIG. 7).

Next, a method of producing an arc tube in which the above-described apparatus is used will be described with reference to FIGS. 1 to 3.

FIG. 1A shows an evacuation step which is conducted after the glass tube is first pinch sealed. In the evacuation step, the upper open end of the glass tube W is connected to the connection head 12, the glass tube W is evacuated through the vent hole 18, and a washing operation in which supply and exhaust of argon gas are repeated is conducted.

Figure 1B:
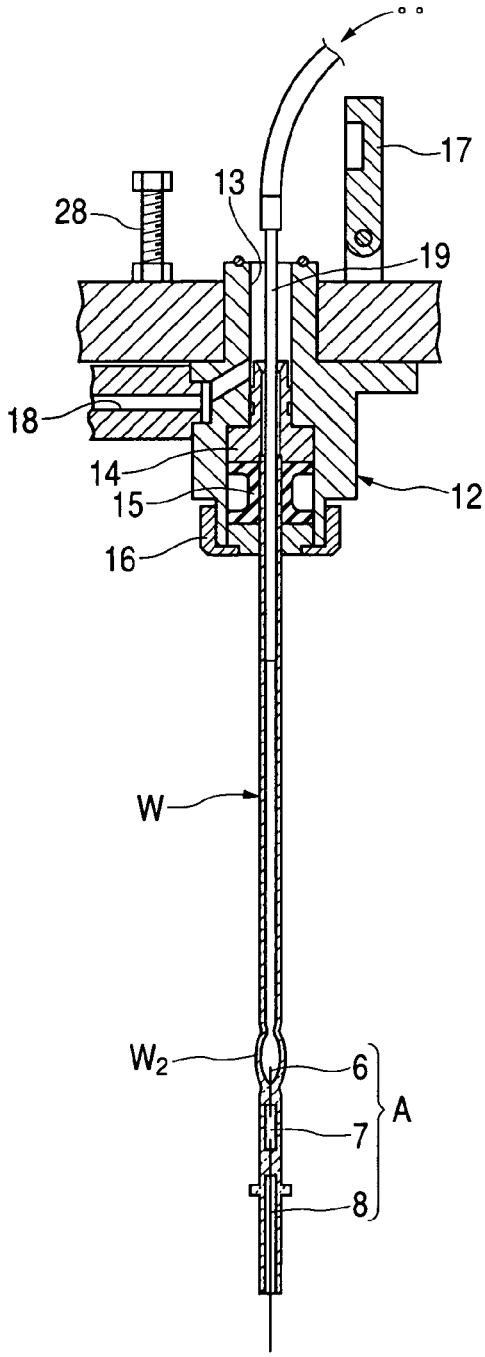
FIG. 1B is a diagram illustrating steps of supplying pellets and mercury.

When the evacuation step is ended, the openable and closable lid 17 is opened as shown in FIG. 1B, and a pellet supply step is conducted to supply pellets serving as a light emitting substance, into the chamber portion w2 from a nozzle 19 which is inserted into the glass tube W through the supply hole 13. Furthermore, a mercury supply step is conducted to supply mercury into the chamber portion w2 from a nozzle (not shown) which is inserted into the glass tube W through the supply hole 13.

Figure 2A:
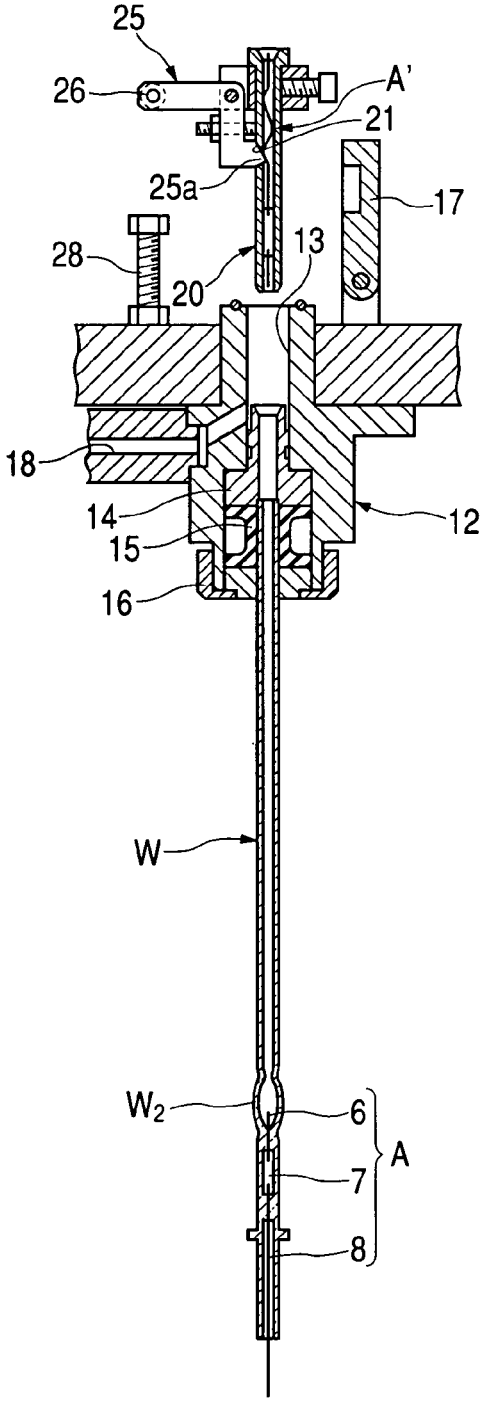
FIG. 2A is a diagram illustrating a step of supplying an electrode assembly to a guide pipe.
Figure 2B:
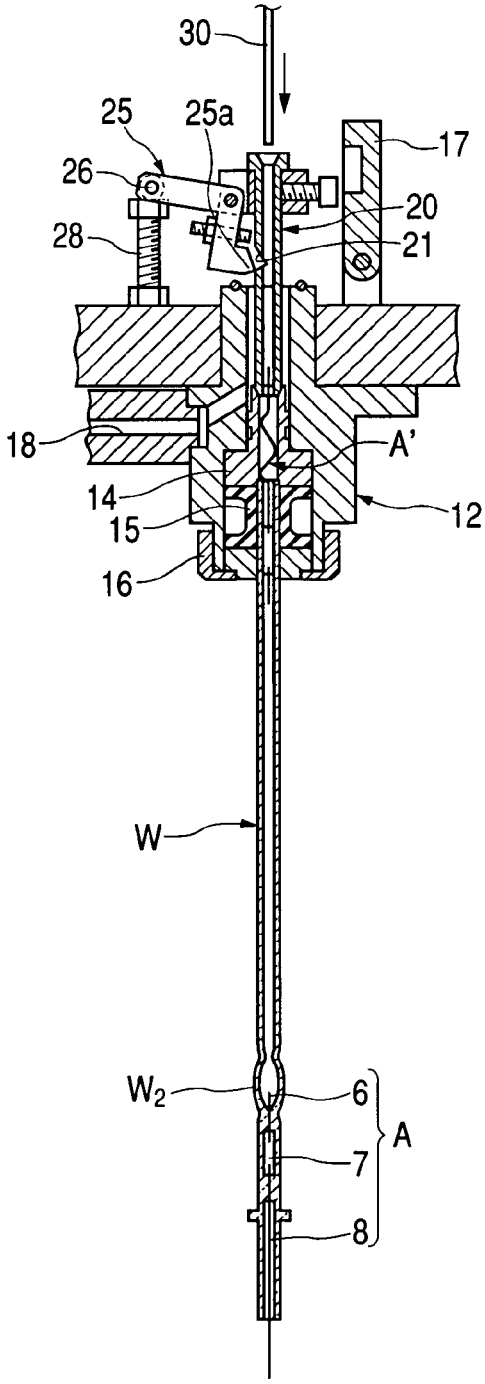
FIG. 2B is a diagram illustrating a step of inserting the electrode assembly into a glass tube.

Thereafter, the process is transferred to the electrode assembly insertion step shown in FIG. 2. In the step, as shown in FIG. 2A, the electrode assembly A' is inserted into the guide pipe 20 which is made of stainless steel, to be held into the pipe 20, and the guide pipe 20 is horizontally moved to a position directly above the supply hole 13. Unlike in the related art method, a holding chuck (not shown) for holding the electrode assembly A' and inserting the assembly into the guide pipe 20 is not required to deeply insert the electrode assembly A' into the glass tube W, but requested to have only a function of inserting the electrode assembly A' into the guide pipe 20. Consequently, the shape restriction that the holding chuck must be thin and long is eliminated. When the holding chuck is configured to be thick and short, the holding chuck is ensured to exert a holding force by which the electrode assembly A' can be adequately grasped, so that the electrode assembly A' can be correctly inserted by using the holding chuck at a predetermined circumferential position where the electrode assembly A' is axially engaged with the inner side of the guide pipe 20 (the predetermined circumferential position where the bent portion 8*a* of the lead wire is engaged with the vertical grooves 22).

The electrode assembly A' which is inserted into the guide pipe 20 is engaged with the stopper lever 25 to be held in the pipe in the form where the assembly is not largely protruded to the lower side of the pipe 20, and the guide pipe 20 can be horizontally moved at a position which is vertically close to the supply hole 13 (a position which is not largely upward separated from the supply hole 13).

Next, as shown in FIG. 2B, the guide pipe 20 into which the electrode assembly A' is inserted and held is lowered to be inserted into the supply hole 13, and a pushing member 30 pushes the electrode assembly A' to insert the assembly into the glass tube W.

Specifically, when the guide pipe 20 is lowered toward the supply hole 13, the stopper lever 25 butts against the pin 28 to be swung, whereby the engagement of the bent portion 8*a* is canceled. The electrode assembly A' falls to the position where the bent portion 8*a* butts against the upper open end of the glass tube W, without being in sliding contact with the inner peripheral faces of the guide pipe 20 and the connection guide 14, and while maintaining the circumferential position which is restricted by the vertical grooves 22. The electrode assembly is held to the position. At the same time when the operation of lowering the guide pipe 20 is started, the pushing member 30 is lowered to push the electrode assembly A' in the guide pipe 20 against the resistance exerted by the glass tube W, whereby the electrode assembly A' is pushed to the predetermined position in the glass tube W.

As described above, in the electrode assembly insertion step, the electrode assembly A' is inserted into the glass tube W without being in sliding contact with the inner peripheral faces of the guide pipe 20 and the connection guide 14. Consequently, there is no possibility that the problem of the method in which the electrode assembly A' is inserted into the glass tube W by using a guide pipe having the same inner diameter as that of the glass tube (i.e., the problem in that metal powder which is produced by rubbing and shaving the inner side of a stainless steel guide pipe with a bent portion of a lead wire is enclosed in a chamber portion as a foreign matter) is caused.

Figure 6:
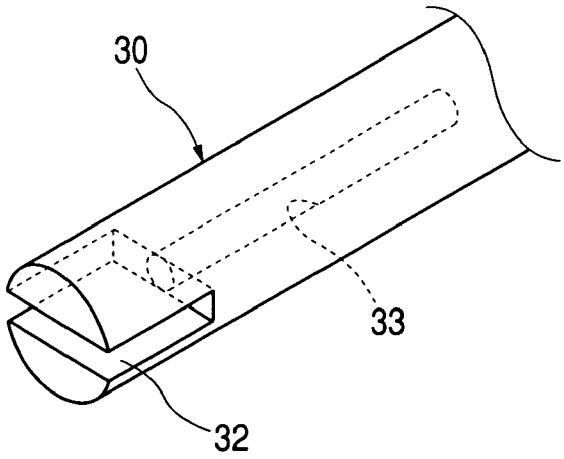
FIG. 6 is an enlarged perspective view of a tip end portion of the pushing member.

The outer diameter of the pushing member 30 which pushes the electrode assembly A' is 1.6 mm which is sufficiently smaller than the inner diameter (2.0 mm) of the glass tube W. Consequently, there is no possibility that the pushing member 30 interferes with the guide pipe 20 and the glass tube W when the pushing member is lowered to push the electrode assembly A'. As shown in FIGS. 6 and 7, a slit engagement portion 32 with which a rear end region 8*b* extending from the tip end of the lead wire 8 to a part of the bent portion 8*a* can be engaged is formed in a tip end portion of the pushing member 30. When the slit engagement portion 32 is engaged with the rear end region 8*b* of the lead wire 8, the electrode assembly A' has a form where the assembly is rotationally locked with respect to the pushing member 30. The reference numeral 33 denotes a hole which axially elongates in the pushing member, and with which a linear portion on the rear end side of the lead wire 8 is to be engaged.

The electrode assembly A' is pushed into the glass tube W against the resistance which is exerted on the bent portion 8*a* by the glass tube W. However, the electrode assembly is circumferentially fixed with respect to the pushing member 30. As a result of the engagement with the vertical grooves 22 of the guide pipe 20, the electrode assembly is held in the form where it is circumferentially positioned. After the insertion of the electrode assembly A' into the glass tube W is ended, therefore, the electrode assembly A' has a form where it is circumferentially positioned with respect to the electrode assembly A on the first-pinch-seal side. Even when an operation of circumferentially positioning the electrode assembly A' is not performed, the process can be transferred to the evacuation step, the xenon gas supply step, and the provisional seal step which are shown in FIG. 3.

Figure 3:
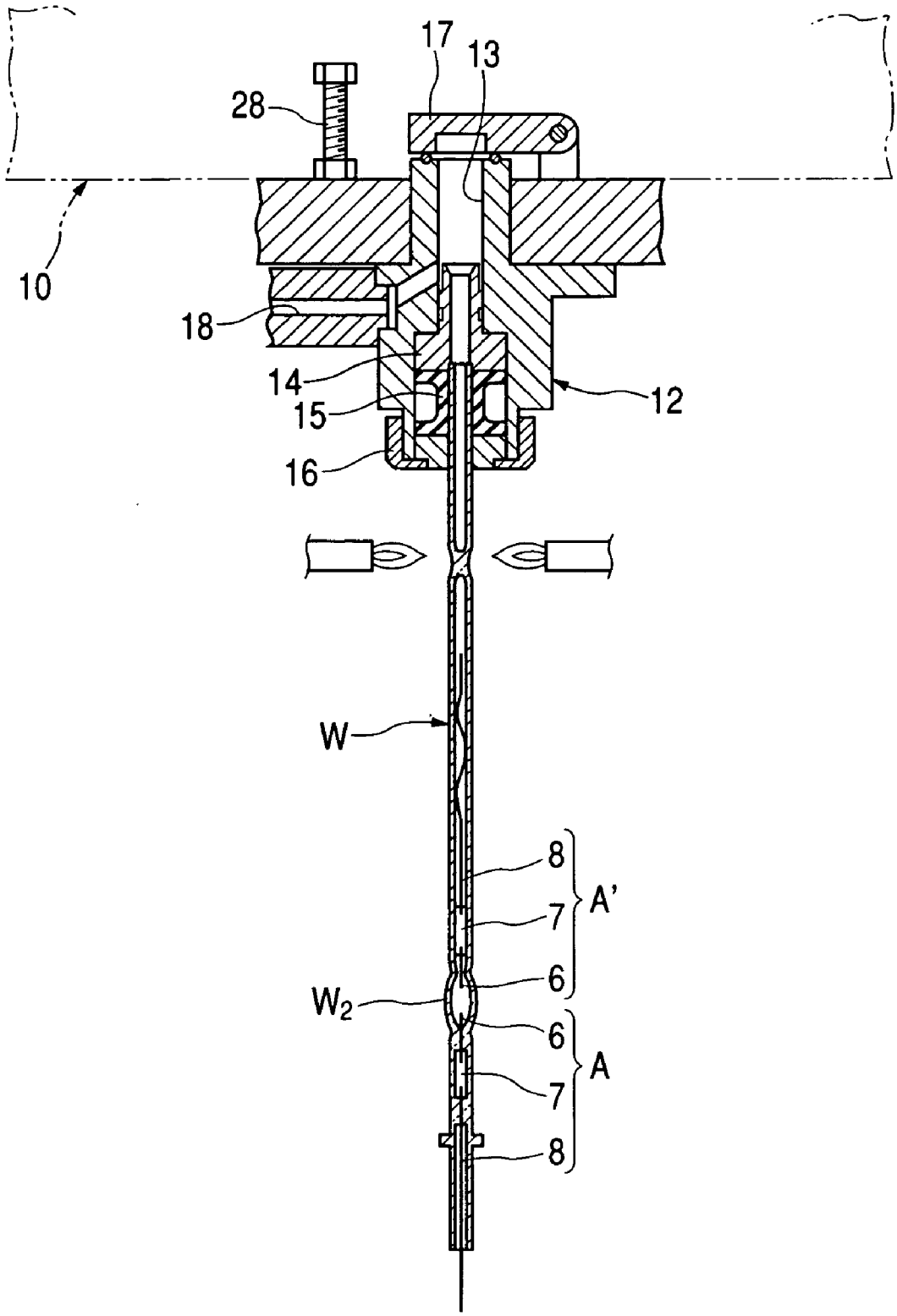
FIG. 3 is a diagram illustrating steps of evacuation, supplying xenon gas, and provisional sealing.
Figure 4A:
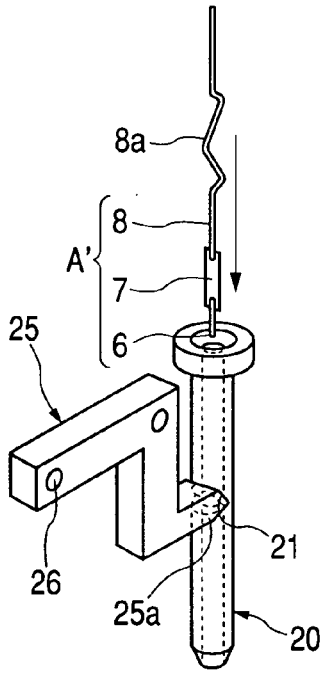
FIGS. 4*a*–4*d* are diagram showing a manner of inserting the electrode assembly into the guide pipe to be once held thereto, and then pushing the electrode assembly by a pushing member to insert the assembly into the glass tube.
Figure 4B:
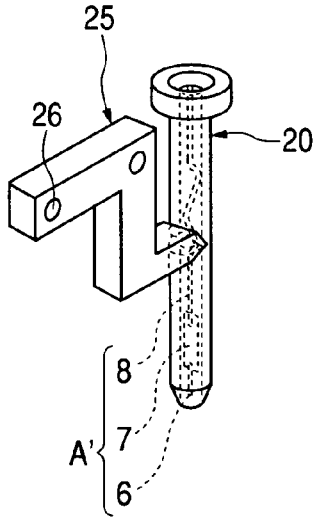
Figure 4C:
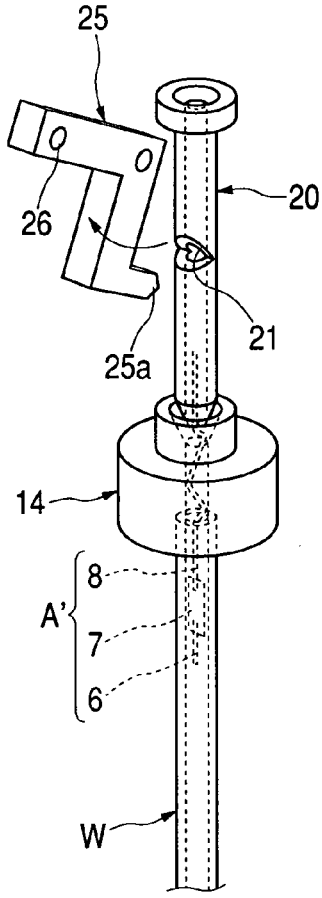
Figure 4D:
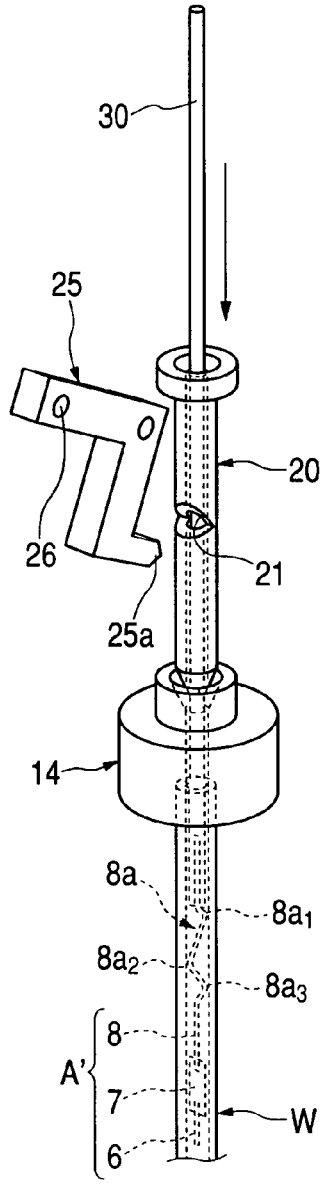

In the steps shown in FIG. 3, the glass tube W is evacuated through the vent hole 18, xenon gas is supplied into the glass tube W, and the open end of the glass tube W is provisionally sealed by using burners. Then, the glass tube W is disconnected from the connection head 12, the electrode assembly A' is sealing attached by the second pinch seal, and the glass tube is cut at a predetermined position on the side of the provisional sealing to expose the lead wire 8 from the glass tube.

The flicker occurrence rates of arc tubes which were produced by the method of the embodiment were measured. FIG. 8 shows the result. In a comparative example (arc tubes which were produced by the method described above), metal powder (Fe, Ni, and Cr which are major components of stainless steel constituting a guide pipe) is contained at a volume ratio of 2% (average) with respect to the total amount of filling materials in a sealed chamber, and the flicker occurrence rate is as high as 19.1%. By contrast, in arc tubes which were produced by the method of the embodiment, metal powder (Fe, Ni, and Cr which are major components of stainless steel constituting a guide pipe) is contained at a volume ratio of 500 ppm or less (average) with respect to the total amount of filling materials in a sealed chamber, and the flicker occurrence rate is 1.2% which is much smaller than that of the comparative example.

In the embodiment described above, the apparatus has a structure in which the connection head 12 and one guide pipe 20 are disposed correspondingly to one glass tube W. From the viewpoint of mass-producing arc tubes, an actual process is preferably configured in the following manner. Electrode assemblies are sequentially inserted into respective guide pipes. After the insertion of an electrode assembly is completed for all the guide pipes, all the guide pipes are integrally moved in parallel to positions directly above the respective glass tubes, and the engagement of the electrode assembly by the stopper in all the guide pipes is canceled when all the guide pipes are integrally lowered to be placed near the glass tubes. A plurality of pushing members are simultaneously lowered to concurrently insert the electrode assemblies into the glass tubes.

In the embodiment described above, the guide pipe 20 is provided with the stopper lever 25 in order to hold the inserted electrode assembly A' into the pipe. However, the stopper lever 25 is not essential. Alternatively, the guide pipe 20 which is not provided with the stopper lever 25 may be inserted and placed into the supply hole 13, and the electrode assembly A' may be then inserted into the guide pipe 20. In the alternative, the electrode assembly A' which is inserted into the guide pipe 20 is held in a form where the assembly butts against the upper open end of the glass tube W. Therefore, the pushing member 30 can be inserted through the supply hole 13 to push the electrode assembly A', whereby the assembly is inserted into the glass tube W.

As apparent from the above description, according to the method of producing an arc tube for a discharge lamp device of the invention, a holding chuck of a holding member for holding the electrode assembly and inserting the assembly into the glass tube is required to have only a function of holding and inserting the electrode assembly into the guide pipe which is disposed on an open end of the glass tube. Consequently, the shape restriction that the holding chuck must be thin and long is eliminated. When the holding chuck is configured to be thick and short, the holding chuck is ensured to exert a holding force by which the electrode assembly can be adequately grasped, so that the electrode assembly can be correctly inserted by using the holding chuck at a predetermined circumferential position where the held electrode assembly is engaged with the guide pipe (a predetermined circumferential position where the bent portion is engaged with the grooves).

The electrode assembly which is once held into the guide pipe and then pushed by the pushing member to be inserted into the glass tube maintains the form where the assembly is circumferentially positioned. Even when an operation of adjusting the circumferential position of the electrode assembly is not performed after the electrode assembly insertion step, therefore, the process can be transferred to the first-pinch-seal step. The process time for producing an arc tube can be correspondingly shortened.

When the electrode assembly is to be inserted into the glass tube via the guide pipe, the electrode assembly is guided to the glass tube without being in sliding contact with the guide pipe. Consequently, there is no possibility that a flickering phenomenon, an abnormal emission color, an insufficient luminous flux, or the like is caused by metal powder which is produced by rubbing and shaving the inner side of the guide pipe with the bent portion of the lead wire of the electrode assembly, and which is enclosed in the chamber portion as a foreign matter.

Particularly, the electrode assembly which is inserted into the guide pipe can be inserted into the glass tube after the assembly is once held into the pipe. Therefore, electrode assemblies can be simultaneously inserted to plural glass tubes, respectively. The method is most suitable for mass-production of an arc tube for a discharge lamp device.

According to the configuration of (2) above, when the electrode assembly is to be inserted into the glass tube via the guide pipe, the M-shaped bent portion of the electrode assembly is engaged with the grooves of the guide pipe, and the electrode assembly is held into the guide pipe while being circumferentially positioned. The electrode assembly is then pushed by the pushing member to be pressed into the glass tube while maintaining the form where the electrode assembly is correctly circumferentially positioned. Therefore, the process can be transferred to the pinch seal step without adjusting the circumferential position of the electrode assembly after the electrode assembly insertion step. The steps of producing an arc tube can be correspondingly simplified.

The electrode assembly insertion is conducted in a limited enclosed space in an inert gas atmosphere, such as a glove box. According to the configuration of (3) above, the guide pipe into which the electrode assembly is inserted and held at a position which is separated from the placement position of the glass tube is moved (for example, slid) to a position directly above the glass tube, and the guide pipe in which the electrode assembly is held by the stopper so that the downward protrusion of the assembly is made as small as possible is moved. Therefore, the facility required for conducting the electrode assembly insertion step, such as the limited enclosed space in an inert gas atmosphere can be miniaturized.

Although the invention has been described in its preferred embodiments, it is understood that the invention is not limited to the specific above-described embodiments.

What is claimed is:

1. A method of producing an arc tube for a discharge lamp device, comprising:

inserting an electrode assembly into a glass tube to self-hold said electrode assembly to a predetermined position of said glass tube, said electrode assembly being formed by connecting and integrating an electrode rod and a molybdenum lead wire to each other via a molybdenum foil, a bent portion being formed in said lead wire, said bent portion having a width which is larger than an inner diameter of said glass tube; and pinch-sealing a portion of said glass tube where said electrode assembly is inserted, wherein during the insertion of the electrode assembly, the electrode assembly is inserted via a guide pipe which is coaxially disposed in close proximity to said glass tube, a pair of grooves being disposed in an inner side of said guide pipe, said grooves being to be engaged with said bent portion of said lead wire.

2. A method of producing an arc tube for a discharge lamp device according to claim 1, wherein said electrode assembly which is inserted into said guide pipe to be once held in said pipe is configured to be pushed into said glass tube by a pushing member which is inserted into said guide pipe, and a slit is formed in a tip end portion of said pushing member, said slit being to be axially engaged with said bent portion of said lead wire which portion is formed into an M-like shape, to circumferentially lock said M-shaped bent portion.

3. A method of producing an arc tube for a discharge lamp device according to claim 1, wherein said guide pipe is placed in close proximity to an upper open end of said glass tube which vertically elongates, a stopper which is insertable into and retractable from said guide pipe is disposed on said guide pipe, said stopper being to be engaged with and disengaged from said bent portion of said lead wire of said electrode assembly which is inserted into said guide pipe, and said electrode assembly which is inserted into said guide pipe in said electrode assembly insertion step is engaged with said stopper to be held into said pipe.

4. A method of producing an arc tube for a discharge lamp device, comprising:

inserting an electrode assembly including a lead wire having bent portion thereof into a guide pipe, wherein at least a portion of said bent portion is inserted into said guide pipe;

positioning the guide pipe with the inserted electrode assembly so that it is coaxially disposed in close proximity or in contact with a glass tube of the arc tube;

disengaging the electrode assembly from the guide pipe so that it is operable to depart from the guide pipe and be partially inserted into the glass tube; and pinch-sealing a portion of the glass tube where the electrode assembly is inserted.

5. A method of producing an arc tube for a discharge lamp device according to claim 4, wherein the guide pipe includes one or more grooves disposed on an inner side thereof, the grooves aligned with the bent portion of the lead wire.

6. A method of producing an arc tube for a discharge lamp device according to claim 4, wherein the bent portion is formed to have a width that is larger than an inner diameter of the glass tube.

7. A method of producing an arc tube for a discharge lamp according to claim 6, wherein the electrode assembly, when partially inserted into the glass tube, is self-held at a predetermined position by the bent portion.

8. A method of producing an arc tube for a discharge lamp according to claim 4, further comprising using a pushing member to facilitate insertion of the electrode assembly into the glass tube.

9. A method of producing an arc tube for a discharge lamp according to claim 8, wherein the pushing member includes a slit formed in a tip end portion of the pushing member, and wherein when using the pushing member to facilitate insertion of the electrode assembly into the glass tube, the slit axially engages with the bent portion of the lead wire to circumferentially lock the bent portion.

10. A method of producing an arc tube for a discharge lamp according to claim 4, wherein the guide pipe includes a stopper operable to engage with the bent portion of the lead wire and hold the electrode assembly in the guide pipe, and operable for retraction to allow the electrode assembly to disengage from the guide pipe.

* * * * *